US005220981A

United States Patent [19]

Kähkipuro et al.

[11] Patent Number: 5,220,981

[45] Date of Patent: Jun. 22, 1993

[54] ELEVATOR AND A PROCEDURE FOR ITS CONTROL

[76] Inventors: Matti Kähkipuro, Kauppalankatu 3, SF-05800 Hyvinkää; Jouko Perttula, Jukolankatu 20, SF-05830 Hyvinkää, both of Finland

[21] Appl. No.: 808,639

[22] Filed: Dec. 17, 1991

[30] Foreign Application Priority Data

Dec. 17, 1990 [FI] Finland ..... 906229

[51] Int. Cl.[5] ..... B66B 9/00

[52] U.S. Cl. ..... 187/16; 187/113

[58] Field of Search ..... 187/16, 1 R, 113

[56] References Cited

U.S. PATENT DOCUMENTS

| | | | |
|---|---|---|---|
| 1,914,128 | 6/1933 | James et al. | 187/16 |
| 1,946,982 | 2/1934 | McPeak | 187/16 |
| 2,704,609 | 3/1955 | Zeckendorf et al. | 187/16 |

FOREIGN PATENT DOCUMENTS

| | | |
|---|---|---|
| 177741 | 8/1985 | European Pat. Off. . |
| 3611173 | 10/1986 | Fed. Rep. of Germany . |
| 81554 | 7/1990 | Finland . |

*Primary Examiner*—Robert P. Olszewski
*Assistant Examiner*—Kenneth Noland

[57] ABSTRACT

The invention relates to an elevator comprising an elevator car unit containing at least two elevator cars and to a procedure for controlling the elevator. According to the invention, at least one elevator car can be moved vertically within the elevator car unit relative to its frame. The procedure is characterized in that prior to start-up, the exact distances between landings are measured and stored in memory. The distance data corresponding to the control instruction according to a unit call or car call is then determined, and based on this data, the elevator car unit is caused to move in the shaft to a position corresponding to the call. At least one of the elevator cars is caused to move relative to the frame of the unit to a position corresponding to the distance between the floors in question.

10 Claims, 2 Drawing Sheets

ELEVATOR AND A PROCEDURE FOR ITS CONTROL

BACKGROUND OF THE INVENTION

1. Field of the Invention

The present invention relates to an elevator comprising an elevator car unit containing at least two elevator cars. The invention also relates to a procedure for controlling an elevator.

2. Description of the Background Art

Elevators with car units containing two cars are used as distributor elevators in tall buildings. The elevator car unit may consist e.g. of the safety gear frame. By using these so-called double-decker elevators, it is possible to simultaneously transport double the amount of passengers/goods with the capacity of a single elevator shaft. However, the elevator cars are fixedly mounted in the safety gear frame, and only one of the two cars can be accurately levelled at a floor at a time unless the interfloor distances are exactly equal. Levelling the other car separately takes time and thus reduces the transport capacity.

SUMMARY OF THE INVENTION

The object of the present invention is to provide an elevator system in which the cars can be levelled separately. To achieve this, the elevator system and corresponding procedure of the invention is characterized by the feature that at least one of the elevator cars of the double-decker elevator can be moved vertically within the elevator car unit relative to the double-decker elevator frame.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention and wherein.

DETAILED DESCRIPTION OF THE PREFERRED EMBODIMENTS

Figure 1:
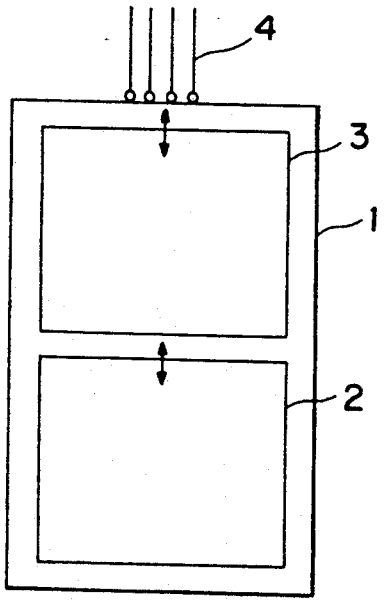
FIG. 1 illustrates a diagram of the elevator car unit of an embodiment of the invention.

FIG. 1 illustrates an elevator car unit 1 whose frame consists of the safety gear frame. The elevator car unit is moved in the elevator shaft by means of hoisting ropes 4. The elevator car can be moved using any techniques known in elevator technology, this being irrelevant to the application of the invention. Similarly, the control system used is irrelevant provided that the elevator car unit can be levelled at positions corresponding to the landings. The elevator car unit 1 comprises two elevator cars 2 and 3. Both cars may be movable inside the unit in its direction of motion, i.e. in the vertical direction, or only one of the cars may be movable while the other is fixedly mounted in the frame of the unit 1.

Figure 3:
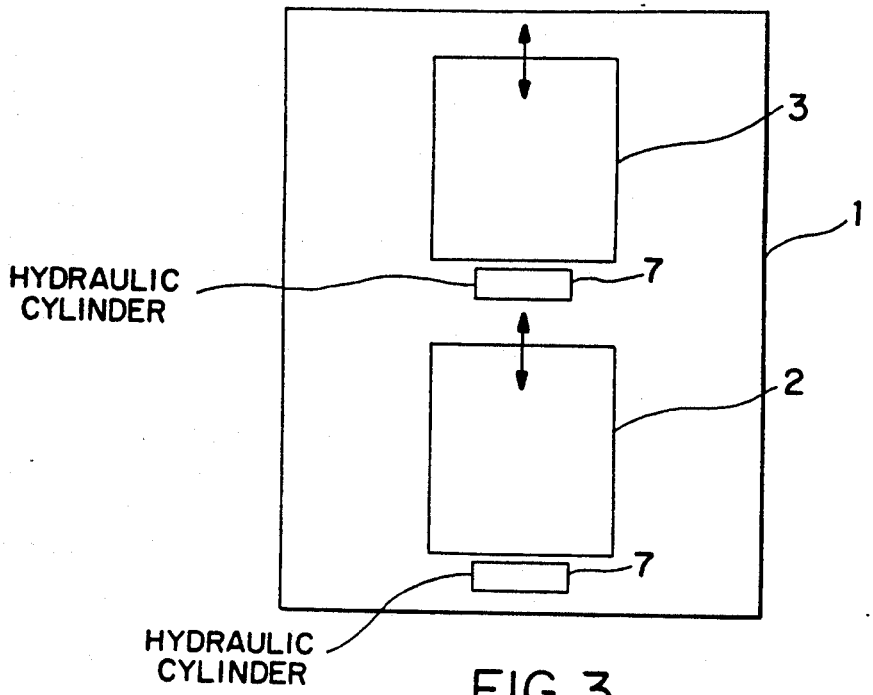
FIG. 3 illustrates an elevator car unit including hydraulic cylinders for moving the cars.
Figure 4:
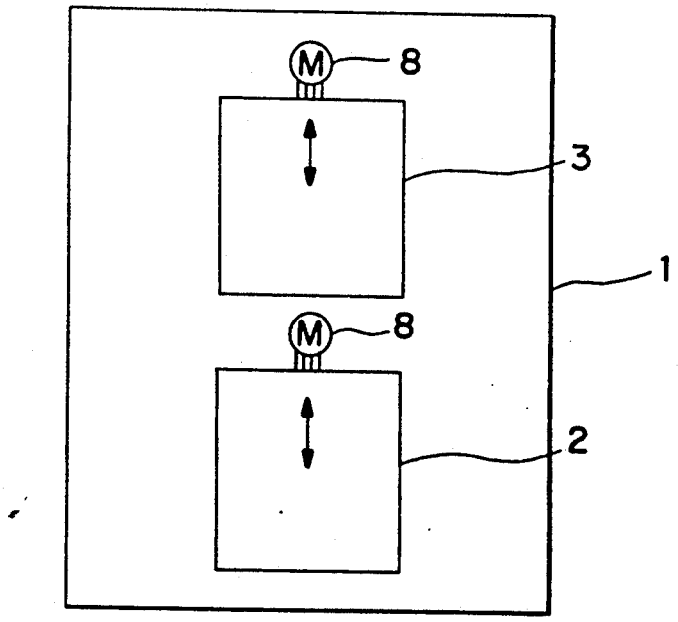
FIG. 4 illustrates an elevator car unit including electric motors for moving the cars.

The elevator cars can be moved inside the frame using various techniques known in elevator technology. The car can be moved by means of a hydraulic cylinder 7 mounted below the car, as illustrated in FIG. 3. The hydraulic cylinder may also be placed above or beside the car as appropriate in each case. The power means may be an electric motor 8 as illustrated in FIG. 4, in which case the car unit contains the sheaves, hoisting ropes and other relevant equipment. The cars can also be moved in the manner employed to move level objects such as lifting platforms or equivalent.

The hoisting machine used to move the elevator car unit 1 can also be utilized to produce the movements of the cars 2 and 3 within the unit 1. In this case, only one power means is needed and the forces transmitted from it to the cars 2 and 3 are controlled by means of a suitable switching element.

Figure 2:
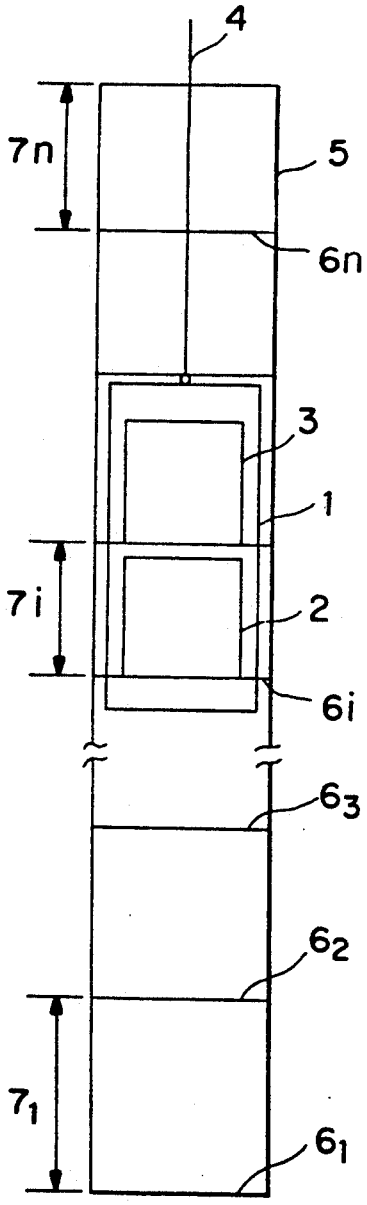
FIG. 2 illustrates an elevator shaft with the elevator car unit moving in it.

FIG. 2 shows an elevator shaft in which the interfloor distances $7_1$–$7_n$ are unequal. A motor moves the elevator car unit 1 along the shaft by means of ropes 4 according to the calls. Upon receiving a call to arrive at a given landing $6_1$, the unit is stopped in a manner determined by the control system so that one of the cars of the unit, either the upper car 1 or the lower car 2, comes level with the landing in question. The elevator car unit 1 itself is stopped at a certain position in relation to the lower one of the landings concerned and the cars are levelled exactly with the landings. If only one of the cars in the frame is movable relative to the car unit 1, naturally only one of the cars is levelled while the first-mentioned car is brought to its proper position along with the car unit. If both cars are movable within the car unit 1, then the elevator car unit 1 can also be stopped at a suitable reference point corresponding to the landing, whereupon both cars can be levelled separately with their respective landings.

According to a preferred embodiment of the invention, the positioning of the elevator cars in their proper places within the frame and in relation to the landing determined by the call is performed in advance during the travel of the car unit. In this case, the levelling of the cars takes no extra time as the cars are moved within the unit simultaneously with the elevator car unit moving in the shaft. The motion of the car unit in the elevator shaft and the car motions within the unit 1 must be so coordinated that the allowed acceleration, deceleration and speed limits are never exceeded.

Prior to the start-up of the elevator, the exact interfloor distances are measured by driving the elevator from end to end of the shaft. The measured distance data are stored in a memory circuit provided in the control unit, implemented using an EPROM circuit or an equivalent programmable memory.

The movements of the elevator cars are regulated by means of an operating unit comprising a power means for moving the car within the elevator car unit 1 as explained above. The position of the car within the unit 1 is determined by means of a measuring or detecting device. The operating unit comprises a memory circuit holding the distance data corresponding to the distances between the floors. When the elevator car unit or an individual elevator car receives a call to arrive at a given landing, the corresponding location data is read from the memory and the car positions relative to the elevator car unit and, if necessary, to each other are established by means of the measuring device. By means of the control unit and by taking the traffic situation into account as necessary, the elevator cars are then moved to the required positions.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. An elevator comprising an elevator car unit containing at least first and second elevator cars, wherein at least said first elevator car can be moved vertically within said elevator car unit, the elevator being provided with control means for controlling controls the movement of said first elevator car within said elevator car unit in accordance with data, stored in a memory, which represents exact distances between floors.

2. The elevator according to claim 1, wherein both said first and second elevator cars can be moved vertically relative to each other within said elevator car unit.

3. The elevator according to claim 2, wherein said elevator car unit is provided with power means by which said first and second elevator cars can be moved.

4. The elevator according to claim 3, wherein said power means is an electric motor.

5. The elevator according to claim 3, wherein said power means is a hydraulic device.

6. A method of controlling an elevator comprising an elevator car unit containing at least first and second elevator cars, the elevator car unit being moved within an elevator shaft by hoisting means, the method comprising the steps of:

measuring and storing in memory means, prior to elevator start-up, distances between landings of the elevator shaft;

reading the distances stored in the memory means in response to operation control instructions corresponding to a unit call or a car call;

moving the elevator car unit in the elevator shaft to an elevator car unit position corresponding to the unit call or the car call; and moving at least the first elevator car within the elevator car unit relative to the second elevator car in accordance with the distance between the landings at the elevator car unit position.

7. The method of controlling an elevator according to claim 6, wherein both the first and second elevator cars are movable within the elevator car unit relative to each other.

8. The method of controlling an elevator according to claim 6, wherein both the first and second elevator cars are moved while the elevator car unit is moving in the elevator shaft.

9. The method of controlling an elevator according to claim 7, further comprising moving the first and second elevator cars within the elevator car unit with an electric motor mounted on the elevator car unit.

10. The method of controlling an elevator according to claim 7, further comprising moving the first and second elevator cars within the elevator car unit with a hydraulic lift mounted within the elevator car unit.

* * * * *